US011548185B2

(12) United States Patent
Moreno

(10) Patent No.: US 11,548,185 B2
(45) Date of Patent: Jan. 10, 2023

(54) DUSTLESS MIXING SYSTEM

(71) Applicant: Luis Moreno, Bonita Springs, FL (US)

(72) Inventor: Luis Moreno, Bonita Springs, FL (US)

( * ) Notice: Subject to any disclaimer, the term of this patent is extended or adjusted under 35 U.S.C. 154(b) by 279 days.

(21) Appl. No.: 17/015,542

(22) Filed: Sep. 9, 2020

(65) Prior Publication Data

US 2022/0072735 A1 Mar. 10, 2022

(51) Int. Cl.

| | |
|---|---|
| ***B28C 5/08*** | (2006.01) |
| ***B28C 5/12*** | (2006.01) |
| ***B01F 33/501*** | (2022.01) |
| ***B01F 35/45*** | (2022.01) |
| ***B01F 35/00*** | (2022.01) |
| ***B08B 15/04*** | (2006.01) |
| ***B08B 15/02*** | (2006.01) |
| ***B01F 101/28*** | (2022.01) |

(52) U.S. Cl.

CPC ..... *B28C 5/0812* (2013.01); *B01F 33/50115* (2022.01); *B01F 35/181* (2022.01); *B01F 35/45* (2022.01); *B08B 15/02* (2013.01); *B08B 15/04* (2013.01); *B28C 5/1215* (2013.01); *B01F 2101/28* (2022.01)

(58) Field of Classification Search

CPC ..... B28C 5/0812; B28C 5/1215; B01F 33/50115; B01F 35/181; B01F 35/45; B01F 2101/28; B01F 35/184; B08B 15/02; B08B 15/04

See application file for complete search history.

(56) References Cited

U.S. PATENT DOCUMENTS

| | | | | |
|---|---|---|---|---|
| 3,967,815 | A | 7/1976 | Backus | |
| 4,071,338 | A * | 1/1978 | Hutter, III | B08B 15/007 141/93 |
| 5,262,578 | A * | 11/1993 | Hall | B25J 21/02 588/259 |
| 5,983,445 | A * | 11/1999 | Baker | B08B 15/04 408/67 |
| 6,491,070 | B1 | 12/2002 | Espina Frutos | |
| 8,337,580 | B2 * | 12/2012 | Manska | B04C 5/103 55/467 |
| 9,624,036 | B2 | 4/2017 | Luharuka et al. | |
| D793,456 | S * | 8/2017 | Lindsay | D8/86 |
| 2003/0200999 | A1 * | 10/2003 | Clark | B08B 15/04 134/32 |
| 2005/0000052 | A1 * | 1/2005 | Byles | B23Q 11/0046 15/301 |

(Continued)

FOREIGN PATENT DOCUMENTS

| | | |
|---|---|---|
| DE | 3504848 C1 | 5/1986 |
| DE | 4303584 A1 | 8/1994 |

(Continued)

*Primary Examiner* — Charles Cooley
(74) *Attorney, Agent, or Firm* — Mark Terry

(57) ABSTRACT

An apparatus for preventing proliferation of dust during mixing of material, including a semi-dome shaped element configured for placement over a top opening of a mixing container, a fastener extending along a bottom circumference of the semi-dome shaped element, such that the fastener is configured to couple to the top brim of the mixing container, and an opening in the semi-dome shaped element, the opening configured to accept a vacuum hose.

12 Claims, 9 Drawing Sheets

(56) References Cited

U.S. PATENT DOCUMENTS

| | | | | |
|---|---|---|---|---|
| 2007/0210081 | A1* | 9/2007 | Bongiornio | B44D 3/08 220/4.03 |
| 2007/0289662 | A1 | 12/2007 | DeMatteis | |
| 2009/0016151 | A1* | 1/2009 | Beaton | B28C 5/0806 366/139 |
| 2009/0016152 | A1* | 1/2009 | Beaton | B08B 15/007 366/139 |
| 2011/0162838 | A1 | 7/2011 | Mackenzie et al. | |
| 2014/0115821 | A1* | 5/2014 | Beaton | B08B 15/007 15/415.1 |
| 2016/0030937 | A1 | 2/2016 | Gabriel | |
| 2016/0325216 | A1 | 11/2016 | Guth et al. | |
| 2019/0217263 | A1* | 7/2019 | Scarborough | B01F 23/50 |
| 2019/0276225 | A1 | 9/2019 | Warren et al. | |
| 2020/0038825 | A1 | 2/2020 | Weeter et al. | |
| 2020/0048020 | A1 | 2/2020 | Warren et al. | |
| 2020/0107683 | A1 | 4/2020 | Hacker | |
| 2020/0207560 | A1 | 7/2020 | Yoder et al. | |
| 2020/0222868 | A1* | 7/2020 | Cooner | B08B 15/007 |
| 2020/0222869 | A1* | 7/2020 | Cooner | B01F 35/184 |
| 2020/0398237 | A1* | 12/2020 | Beaton | B08B 15/007 |
| 2022/0072735 | A1* | 3/2022 | Moreno | B08B 15/04 |
| 2022/0322899 | A1* | 10/2022 | Reeder | A47L 9/009 |

FOREIGN PATENT DOCUMENTS

| | | | | |
|---|---|---|---|---|
| EP | 2174726 | A1 * | 4/2010 | B08B 15/04 |
| ES | 2244274 | A1 | 12/2005 | |
| WO | 2019197390 | A1 | 10/2019 | |

* cited by examiner

DUSTLESS MIXING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of construction and construction tools and, more specifically, to systems for mixing composite materials composed of fine and coarse aggregate which require mixing for use.

BACKGROUND

The dust produced when mixing substances like concrete and thinset has long been known to cause issues for those frequently coming into contact with it. It is a well-known fact amongst those in industries requiring the mixing and use of said materials that the inhalation or skin contact with the dust produced by these materials can be detrimental to health. Irritation of the nose, eyes, throat, and upper-respiratory system are amongst the most commonly felt symptoms associated with the inhalation of or skin and eye contact with the dust. Regular, repeated contact along with short-term excessive contact with the dust can directly lead to burns on the skin, at times as severe as third-degree burns, or skin ulcers, depending on the level and duration of contact. In addition, many see allergies develop after prolonged or regular exposure to the chemicals and substances found in the dust, leading to injuries similar to those discussed above but with increased intensity. The inhalation of said dust can also lead to choking and difficulty breathing, and in some cases be the cause of the disabling, and often fatal, lung disease called silicosis.

While health concerns are perhaps the most salient issues felt by those engaging in the above-stated activities, other issues exist. The spread of composite material dust is often considered a nuisance on work sites, many blaming it for less productive workdays due to excessive cleaning efforts as well as the costs that arise therefrom. Tool performance and maintenance issues are also known to also rise as a result of the buildup of said dust within, on, or around worksite tools.

Considering the health risks associated with mixing composite materials as well as the inconvenience caused by the dust, many have sought out to reduce the proliferation of the dust that results from such activities. While options exist for those cutting or otherwise engaging with concrete or like materials after it has hardened, few effective options exist for earlier stages of the concrete-making process such as batch mixing. Those that do exist for use at this stage are typically targeted towards collecting dust from large, sophisticated machinery such as trucks, concrete batchers, and silos. These options are not only costly and difficult to ship and install, but also require large areas for installation and generally consume large amounts of energy. As a result, these options are virtually useless for indoor projects, less sophisticated parties like individuals doing DIY projects, and smaller construction teams that use buckets, wheelbarrows, or like tools.

As a result of at least the aforementioned shortfalls, a need exists for a dustless mixing system that easily controls or eliminates the spread of concrete and other composite material dust from the workspace while mixing said materials.

SUMMARY

An apparatus and system for preventing the proliferation of dust during the mixing of composite material is provided. This summary is provided to introduce a selection of disclosed concepts in a simplified form that are further described below in the Detailed Description, including the drawings provided. This Summary is not intended to identify key features or essential features of the claimed subject matter. Nor is this Summary intended to be used to limit the claimed subject matter's scope.

In one embodiment, the apparatus for preventing proliferation of dust during mixing of material comprises a semi-dome shaped element configured for placement over a top opening of a mixing container, a fastener extending along a bottom circumference of the semi-dome shaped element, such that said fastener is configured to couple to the top brim of the mixing container, and an opening in the semi-dome shaped element, the opening configured to accept a vacuum hose.

In another embodiment, the system for preventing proliferation of dust during mixing of material comprises a mixing container for mixing material, a semi-dome shaped element configured for placement over a top opening of the mixing container, a fastener extending along a bottom circumference of the semi-dome shaped element, such that said fastener is configured to couple to a top brim of the mixing container, and an opening in the semi-dome shaped element, the opening configured to accept a vacuum hose.

In another embodiment, the apparatus for preventing proliferation of dust during mixing of material comprises a semi-dome shaped element configured for placement over a top opening of a cylindrical mixing container, wherein the semi-dome shaped element is configured to cover at least half of the top opening of the mixing container, a fastener extending along a bottom circumference of the semi-dome shaped element, such that an entire length of said fastener is configured to couple to a top brim of the mixing container, and an opening in the semi-dome shaped element, the opening including a mounting gasket configured for allowing the passage of a vacuum hose while providing support thereto.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
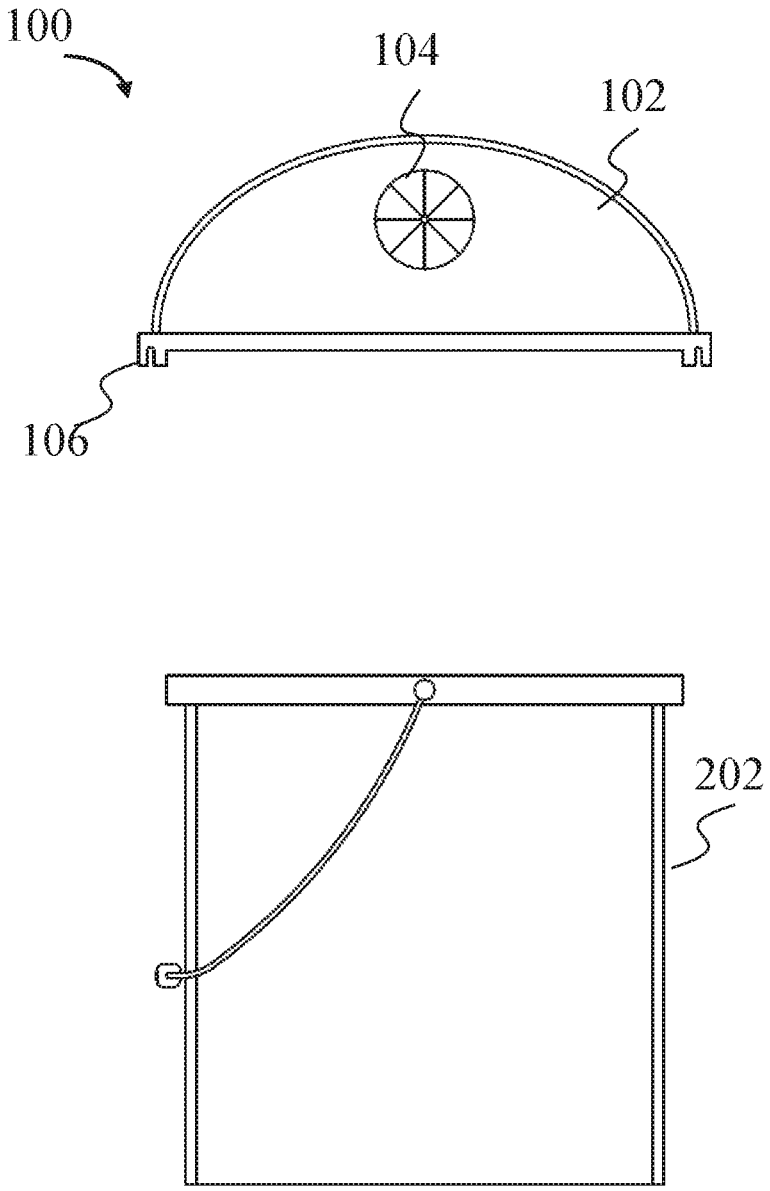
FIG. 1 is a drawing depicting an apparatus for dustless mixing, according to one embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed subject matter improves over the prior art by providing a user-friendly, cost-efficient apparatus for controlling the spread of dust that results from the use of composite material such as concrete. The claimed subject matter specifically improves over the prior art by significantly reducing the proliferation of harmful and difficult to clean dust while mixing composite materials. The claimed subject matter additionally improves over the prior art by providing the above-mentioned benefits in a configuration that facilitates the reduction of said dust during the use of heavy-machinery alternatives such as buckets, using an easy-to-handle and simply designed apparatus. The claimed subject matter additionally improves over the prior art by providing an apparatus that controls the spread of dust, wherein the apparatus can easily be stacked, stored, transported and displayed while optimizing space.

The claimed subject shall now be described with reference to FIGS. 1-9.

Figure 2:
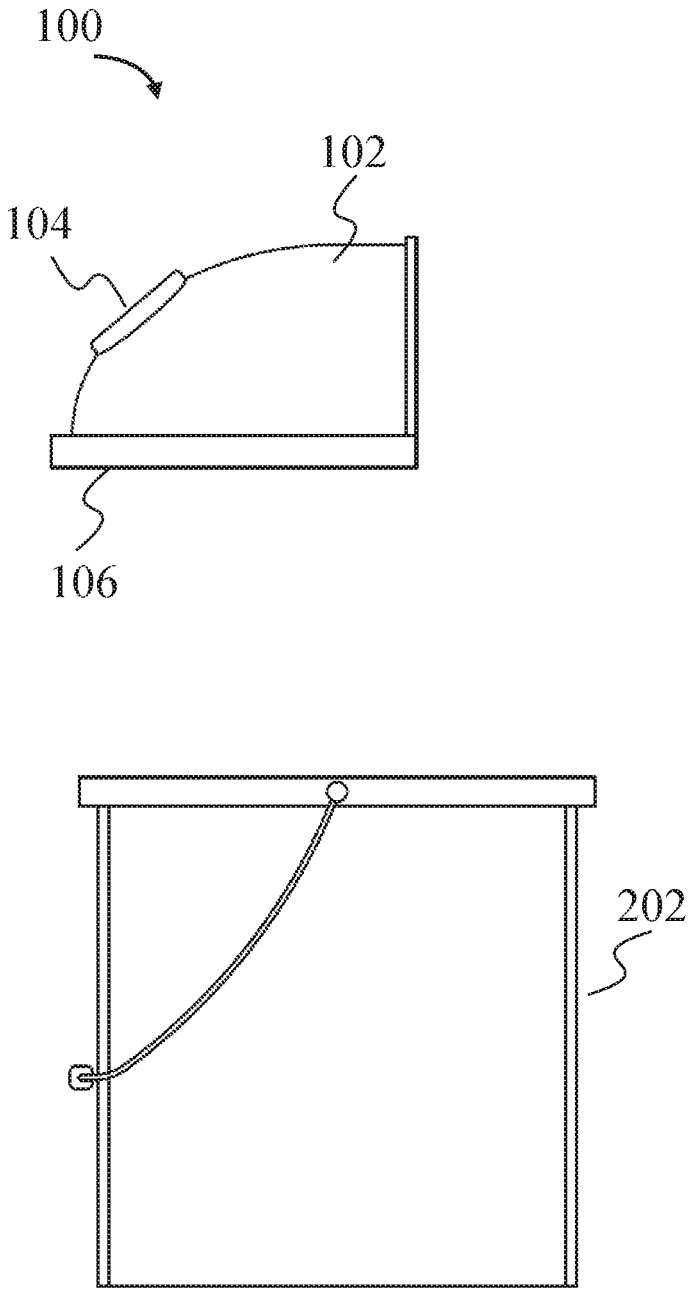
FIG. 2 is a right-side view of the apparatus for dustless mixing, according to one embodiment.

FIGS. 1 and 2 are drawings depicting an apparatus for preventing the proliferation of dust during the mixing of composite materials, according to one embodiment. A semi-dome shaped element 102 is shown in FIG. 1. A semi-dome shape (or half-dome shape) is half of a dome shape (otherwise refereed to as a quarter of a sphere) that covers a semi-circular area. The semi-dome shaped element is truncated to cover a radius of about 5½ inches, or half of the opening of a mixing container 202, which may be a cylindrical bucket, such as a 5-gallon bucket. A composite material is a material made from two or more constituent materials with significantly different physical or chemical properties that, when combined, produce a material with characteristics different from the individual components. Examples of composite materials include concrete, cement, thinset, mortar, grout, etc. Composite material such as concrete is composed of fine and coarse aggregate bonded together with a fluid cement (cement paste) that hardens over time. The combination of the semi-dome shaped element and mixing container may be referred to as the system 100 for dustless mixing.

The semi-dome shaped element 102 is configured to allow coupling to a mixing container 202 (see FIG. 5) using fastener 106. Fastener 106 comprises a narrow semi-circular channel running the length of the semi-dome shaped element and configured to allow either wall of the channel to fit tightly around the brim of the mixing container 202, preventing the apparatus from shifting during use. When coupled, the entire length of the semi-circular channel contacts and couples to the brim of the mixing container 202. When coupled, the fastener 106 may form a friction fit with the brim of the mixing container 202. FIG. 1 further shows an opening or hole 104 in the semi-dome shaped element, the hole configured to permit the passage of a vacuum hose therethrough. FIG. 2 shows a right-side view of the same apparatus shown in FIG. 1, including the semi-dome shaped element 102, hole 104, fastener 106, and mixing container 202.

Figure 3A:
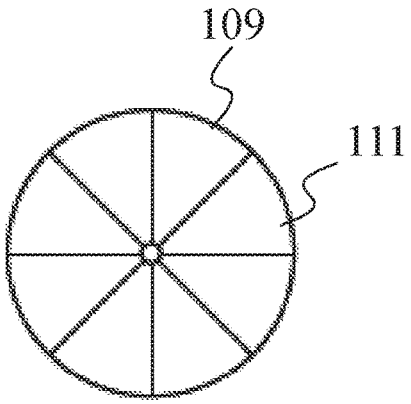
FIG. 3A is drawing depicting a hole on the apparatus for dustless mixing, according to one embodiment.
Figure 3B:
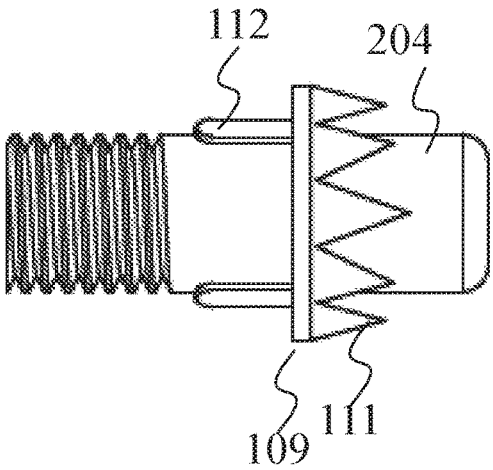
FIG. 3B is a side-view of the hole of FIG. 3A, further depicting a vacuum hose passing through the hole of the apparatus for dustless mixing, according to one embodiment.

FIGS. 3A and 3B are close-up views of the gasket 109 that fits within the hole 104 of the semi-dome shaped element 102. The hole 104 may be circular and completely unobstructed to facilitate the passage of a vacuum hose. Alternatively, the hole 104 may comprise a rubber mounting gasket 109, as shown in FIG. 3A, a plastic grommet, or any item configured in a manner such that it permits the passage of a vacuum hose and provides support for the hose. In another embodiment, the rubber mounting gasket 109 may be a circular shaped element, a toroidal shaped element, or configured in any other shape and configuration that likewise permits the passage of a vacuum hose or hose head attachment 204 therethrough while maintaining the function of the apparatus. FIG. 3A shows that the rubber c includes a series of flexible or bendable flaps 111 that extend from the circumference of the gasket to the middle of the gasket such that in the resting position, the flaps almost completely occlude the opening in the gasket.

FIG. 3B depicts the passage of a vacuum hose head attachment 204 through the mounting gasket 109 of the example embodiment. FIG. 3B shows that the vacuum hose head attachment 204 has been inserted through the mounting gasket 109 such that it fits securely within the gasket and it is supported by the gasket. FIG. 3B shows that the mounting gasket 109 includes a series of flexible or bendable flaps 111 that have been pushed outwards from the opening in the gasket by the vacuum hose head attachment 204. The flexible or bendable flaps 111 provide pressure against the vacuum hose head attachment 204 such that the vacuum hose head attachment fits securely within the gasket and is supported by the gasket. FIG. 3B shows that the mounting gasket 109 includes one or more flanges 112 that extend from the circumference of the gasket towards the semi-dome shaped element 102, such that when the gasket is inserted into the hole 104, the one or more flanges 112 secure the gasket against the semi-dome shaped element 102.

Figure 4:
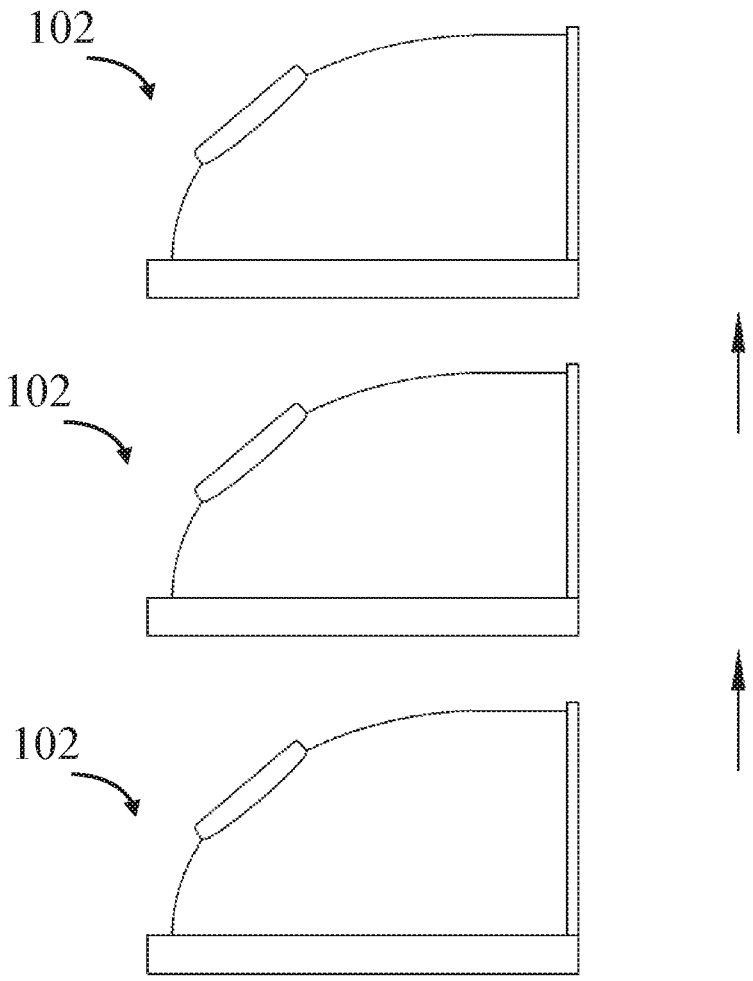
FIG. 4 is a drawing depicting the stackable nature of the apparatus for dustless mixing, according to one embodiment.

FIG. 4 shows the same semi-dome shaped element 100 as the earlier figures, highlighting the stackable nature thereof. The semi-dome shaped element is configured such that several units of the dome shaped element may be stacked one on top of another, reducing shipping costs and the required space for storage and display in retail outlets. This configuration also reduces the space required to transport multiple units to the worksite or to store the units. FIG. 4 shows that the semi-dome shaped void underneath each element 102 fits perfectly on top of the bulbous portion of the top of each dome shaped element. The stackable nature of the semi-dome shaped element 102 optimizes the space necessary to store, transport and display the semi-dome shaped element 102.

Figure 5:
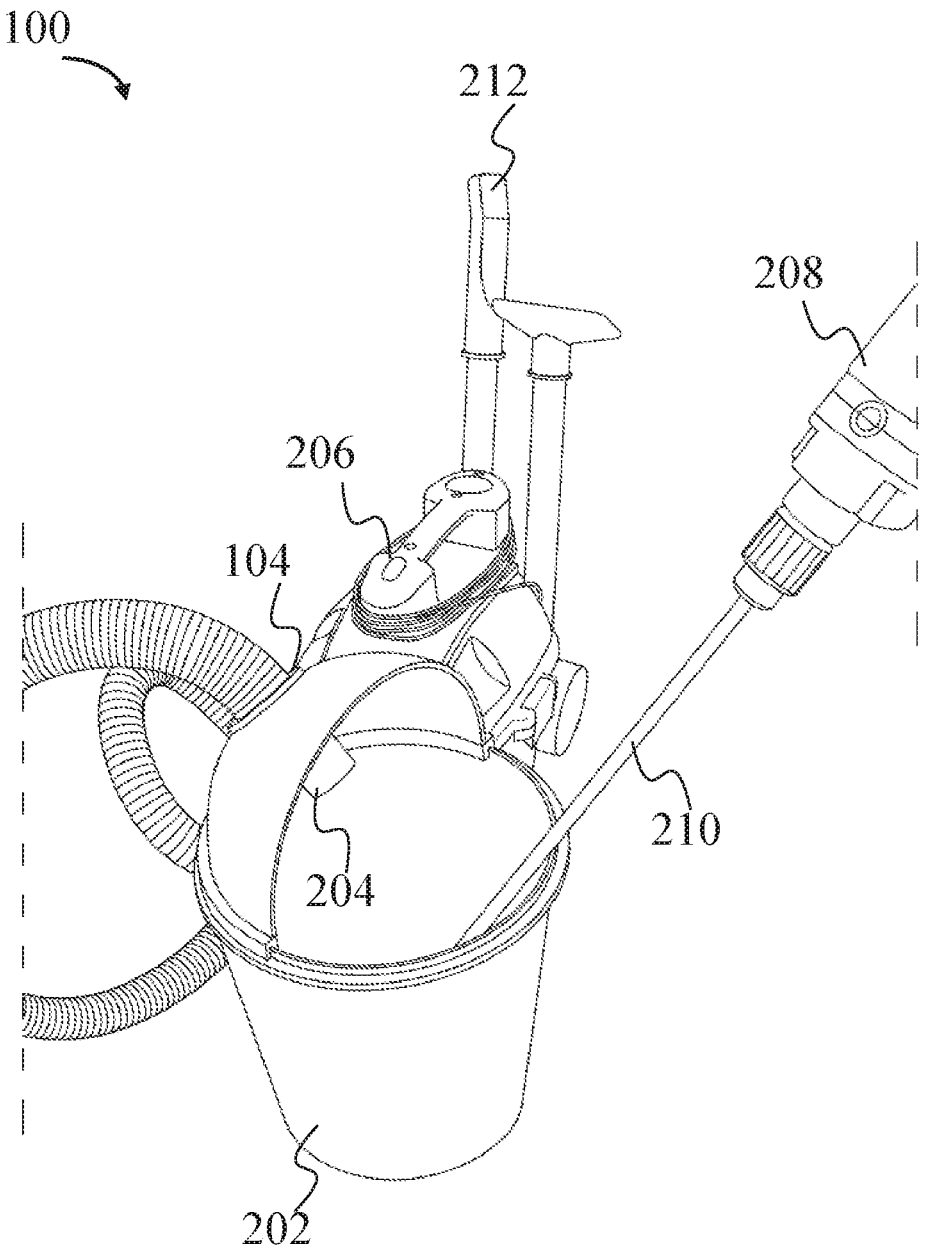
FIG. 5 is a front perspective view of an apparatus and system for dustless mixing, according to one embodiment.

FIG. 5 is a drawing depicting a system 100 for preventing the proliferation of dust during the mixing of composite materials. FIG. 5 shows the apparatus 102 of FIG. 1 and FIG. 2 coupled with mixing container 202 wherein composite materials may be mixed. The mixing container 202 may be a mixing bucket of the type commonly used to mix composite materials such as concrete. This includes but is not limited to a 5-gallon plastic bucket, or similar, with a circular top opening with a diameter of 11 inches. While the present example embodiment discloses a 5-gallon bucket, other size buckets such as an 8 or 12-gallon bucket may be used where appropriate. A hose head attachment 204 is also shown in FIG. 5, the hose head attachment passing through the hole 104 of the apparatus 100. The hose head attachment 204 is connected to a vacuum 206. The vacuum 206 may be any such vacuum with a hose commonly used in the clean up or control of dust and like products, such as a shop vacuum or an industrial vacuum cleaner. The vacuum 206 may further comprise a hose attachment 212 to extend the reach of the vacuum 206 or to fit within the hole 104 of an alternate embodiment of the device 102. FIG. 5 further shows a drill 208 with an attached mixing drill-bit 210 for mixing composite materials within the container 202, which produces dust.

The combination of the semi-dome shaped element 102, container 202, vacuum 206 (and its components) and drill 208 (and its components) may be referred to as the system 100 for dustless mixing. The system 100 is configured such that when the composite material (such as concrete powder) is mixed with water, the hose head attachment in the semi-dome shaped element sucks any proliferating dust into the vacuum. This reduces or eliminates the proliferation of dust into the ambient area during mixing of the composite material.

Figure 6:
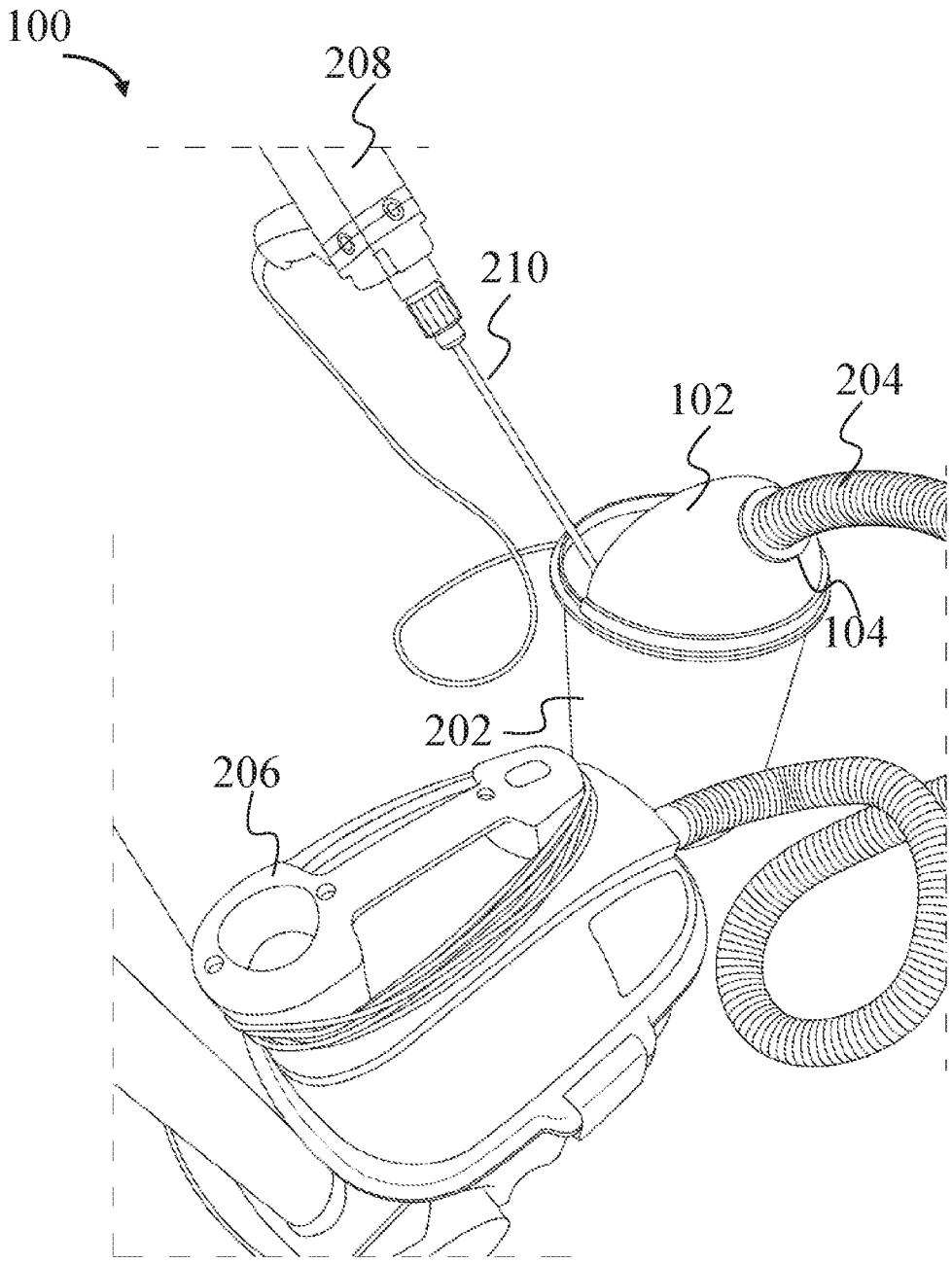
FIG. 6 is a rear perspective view of an apparatus and system for dustless mixing, according to one embodiment.
Figure 7:
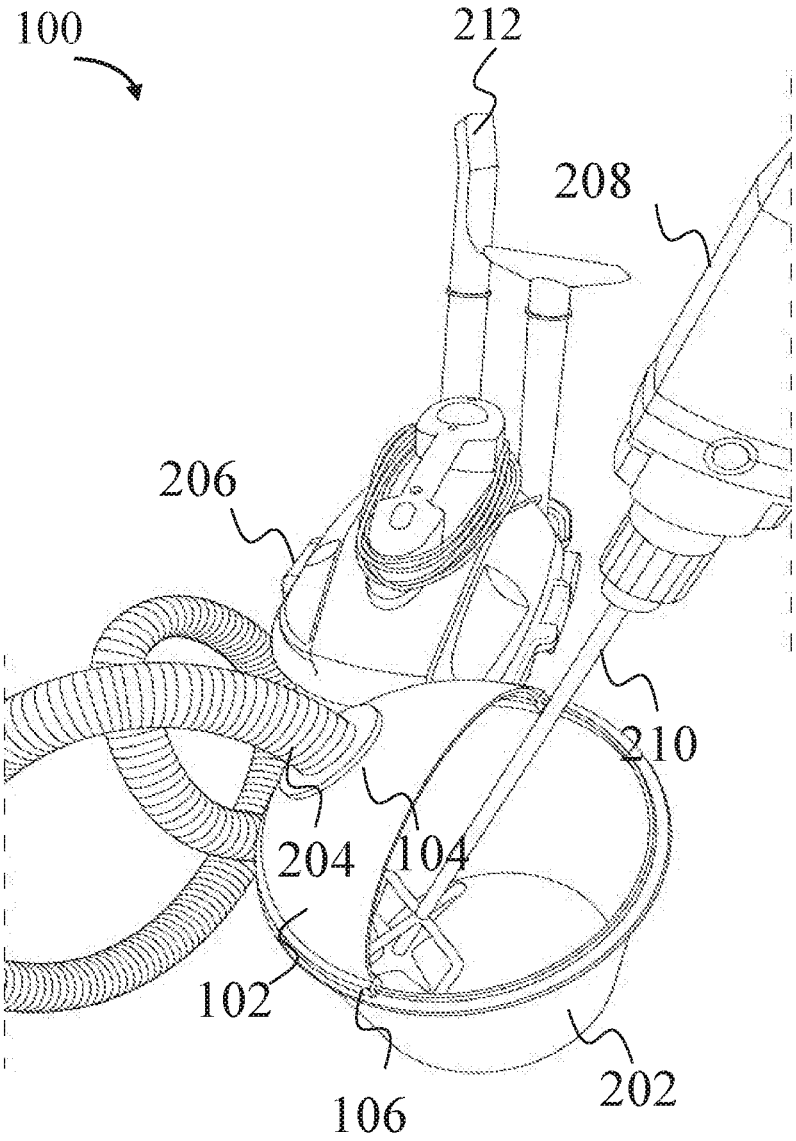
FIG. 7 is a top perspective view of an apparatus and system for dustless mixing, according to one embodiment.
Figure 8:
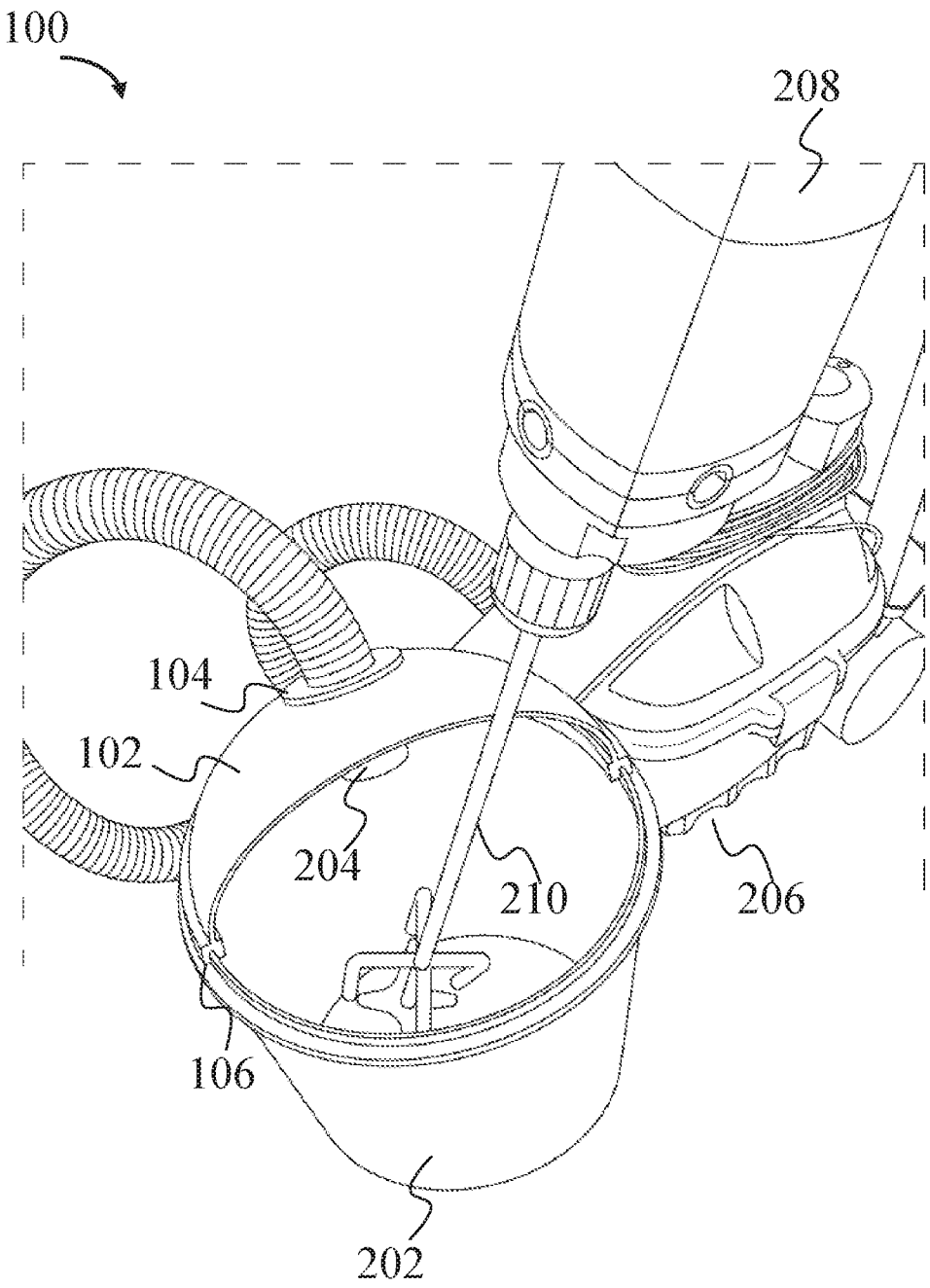
FIG. 8 is another top perspective view of an apparatus and system for dustless mixing, according to one embodiment.
Figure 9:
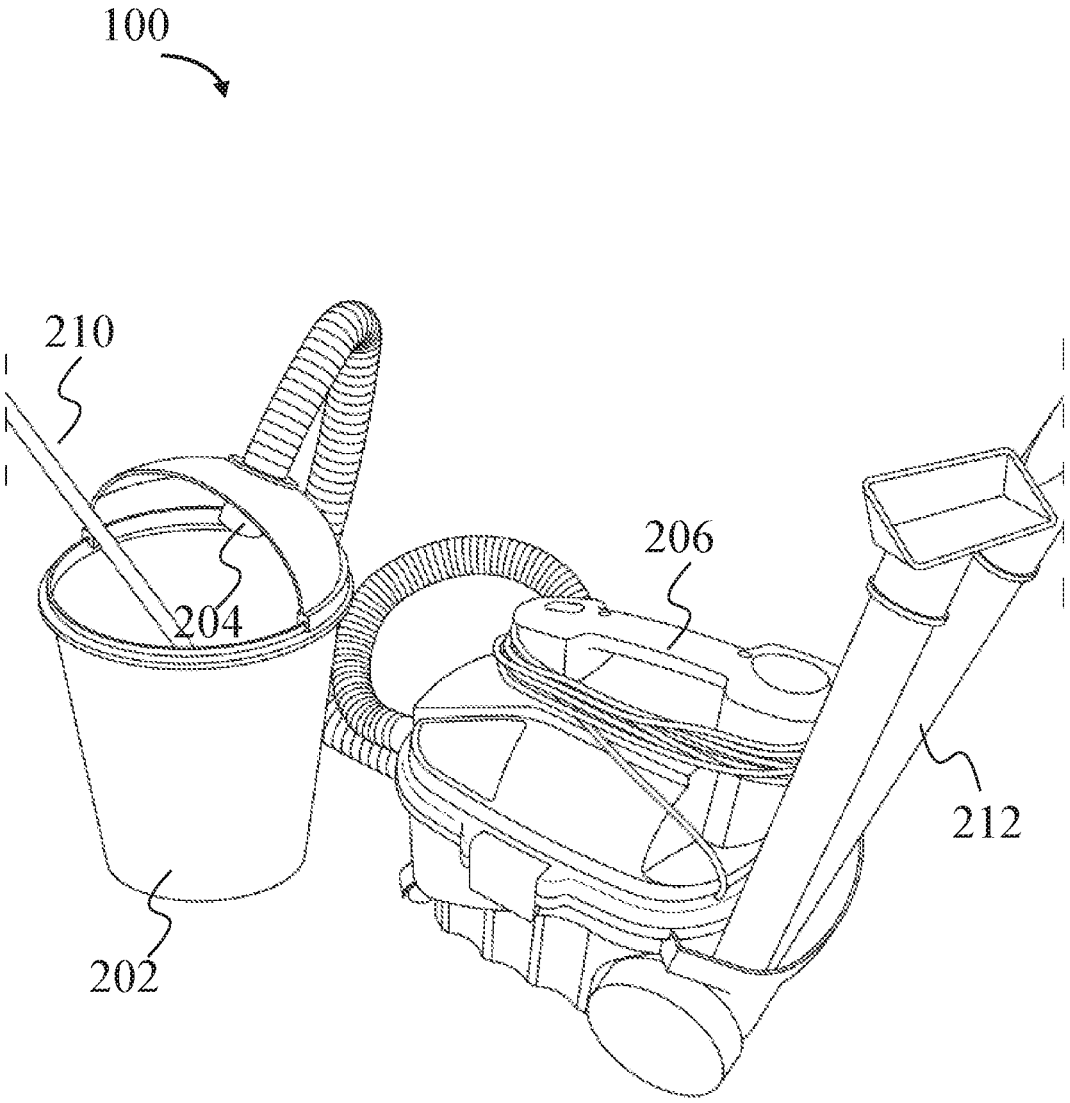
FIG. 9 is a side perspective view of an apparatus and system for dustless mixing, according to one embodiment.

FIGS. 6 through 9 depict the same system 100 of FIG. 5 from varying angles, further disclosing each component of the system 100, according to an embodiment. FIG. 6 showing the system 100 from a rear perspective view and FIGS. 7 and 8 showing the system from a top perspective view, show the mixing drill bit 210 inside of the mixing container 202. The mixing drill bit 210 may be a piano whip or whisk, a spiral mixer, a mixing paddle, or any other mixing drill bit commonly use to mix composite materials such as thinset or concrete. FIG. 9 is a side perspective view of the apparatus 102 and system 100 for dustless mixing, according to one embodiment In one embodiment, the semi-dome shaped element 102 and gasket 109 may be composed of a plastic, such as polyolefin, polyacrylate, polystyrene, polyamide, polyvinyl alcohol, poly(alkylene acrylate), poly(ethylene vinyl alcohol), poly(alkylene vinyl acetate), polyurethane, polyacrylonitrile, polyester, fluoropolymer, polycarbonate, or combinations thereof. In one embodiment, the semi-dome shaped element 102 and gasket 109, or a portion thereof, may comprise a surface that is ink-printable, i.e., the surface allows for ink printing on its surface. In another embodiment, the semi-dome shaped element 102 and gasket 109, or a portion thereof, may be opaque, transparent, semi-transparent, or translucent. In another embodiment, the semi-dome shaped element 102 and gasket 109 may be composed of at least one of a thermoplastic, a thermosetting polymer, polyethylene, polypropylene, polystyrene, polyvinyl chloride, polytetrafluoroethylene (PTFE), polystyrene, polyvinyl chloride, nylon, polyester, polyethylene terephthalate, high density polyethylene, polyvinylidene chloride, high impact polystyrene, or mixtures thereof. The semi-dome shaped element 102 and gasket 109 may further be composed of any moldable plastic, ABS plastic, injection grade plastic, bioplastic or biodegradable plastic. In another embodiment, the semi-dome shaped element 102 and gasket 109, or any portion thereof, may be composed of rubber or a similar type of polymer.

In another embodiment, the semi-dome shaped element 102 and gasket 109, or any portion thereof, may be composed of stainless steel, iron, silver, platinum, gold, zinc, copper, nickel, or any alloys or combinations of the above. The composition of the semi-dome shaped element 102 and gasket 109, or any portion thereof, may be mixed with harder metals for strength and durability.

While certain embodiments have been described, other embodiments may exist. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus for preventing profit ration of dust during mixing of material in a mixing container, the apparatus comprising:

a semi-dome shaped element configured for placement over a top opening of the mixing container, wherein the semi-dome shaped element comprises one half of a dome;

a fastener extending along a bottom portion of the semi-dome shaped element, such that said fastener is configured to couple to a top brim of the mixing container, wherein said fastener extends around one half of the top brim of the mixing container co-extensive with the one half of the dome; and an opening in the semi-dome shaped element, the opening configured to accept a vacuum hose, said opening located generally at a midpoint of the semi-dome shaped element;

wherein when the semi-dome shaped element is fastened to the mixing container, about one half of the top opening of the mixing container is left open for insertion of an implement into the mixing container.

2. The apparatus of claim 1, wherein the semi-dome shaped element is configured to cover at least one half of the top opening of the mixing container.

3. The apparatus of claim 2, wherein the opening of the semi-dome shaped element comprises a mounting gasket configured for allowing the passage of the vacuum hose while providing support thereto.

4. The apparatus of claim 3, wherein the apparatus is further configured such that one unit of the apparatus may be stacked on top of a second unit of the apparatus, so as to optimize space.

5. The apparatus of claim 4, wherein the fastener further comprises a channel running along a length of the bottom portion of the semi-dome shaped element, the channel configured such that each wall of the channel may be placed on the top brim of the mixing container.

6. The apparatus of claim 5, wherein the channel is adapted to form a friction fit with the top brim of the mixing container.

7. An apparatus for preventing proliferation of dust during mixing of material in a cylindrical mixing container, the apparatus comprising:

a semi-dome shaped element configured for placement over a top opening of the cylindrical mixing container, wherein the semi-dome shaped element comprises one half of a dome, and wherein the semi-dome shaped element is configured to cover at least half of the top opening of the cylindrical mixing container;

a fastener extending along a bottom portion of the semi-dome shaped element, such that an entire length of said fastener is configured to couple to a top brim of the mixing container, wherein said fastener extends around one half of the top brim of the cylindrical mixing container co-extensive with the one half of the dome; and an opening in the semi-dome shaped element, the opening including a mounting gasket configured for allowing the passage of a vacuum hose while providing support thereto, said opening located generally at a midpoint of the semi-dome shaped element;

wherein when the semi-dome shaped element is fastened to the cylindrical mixing container, about one half of the top opening of the cylindrical mixing container is left open for insertion of an implement into the cylindrical nixing container.

8. The apparatus of claim 7, wherein the apparatus is further configured such that one unit of the apparatus may be stacked on top of a second unit of the apparatus, so as to optimize space.

9. The apparatus of claim 8, wherein the fastener further comprises a channel running along a length of the bottom portion of the semi-dome shaped element, the channel configured such that each wall of the channel may be placed on the top brim of the mixing container.

10. The apparatus of claim 9, wherein the channel is adapted to form a friction fit with the top brim of the mixing container.

11. The apparatus of claim 10, wherein when the material is mixed with water, the vacuum hose sucks any proliferating dust.

12. The apparatus of claim 11, wherein the semi-dome shaped element is composed of plastic.

* * * * *